US006118086A

United States Patent [19]

Isikawa

[11] Patent Number: 6,118,086

[45] Date of Patent: Sep. 12, 2000

[54] MULTI-DIRECTIONAL INPUT DEVICE

[75] Inventor: Sinzi Isikawa, Miyagi-ken, Japan

[73] Assignee: Alps Electric Co., Ltd., Tokyo, Japan

[21] Appl. No.: 09/505,944

[22] Filed: Feb. 15, 2000

[30] Foreign Application Priority Data

Feb. 23, 1999 [JP] Japan ..... 11-044990

[51] Int. Cl.[7] ..... H01H 25/04

[52] U.S. Cl. ..... 200/6 A

[58] Field of Search ..... 200/4, 5 R, 6 R, 200/6 A, 17 R, 18, 332, 335

[56] References Cited

U.S. PATENT DOCUMENTS 4,414,438 11/1983 Maier et al. ..... 200/6 A
4,459,440 7/1984 Wiczer ..... 200/6 A
5,459,292 10/1995 Nagano et al. ..... 200/5 R

FOREIGN PATENT DOCUMENTS 7-235241 9/1995 Japan ..... H01H 25/04

*Primary Examiner*—Michael Friedhofer
*Attorney, Agent, or Firm*—Brinks Hofer Gilson & Lione

[57] ABSTRACT

A multi-directional input device, in which a spacer member is interposed between a moving contact plate and a cover which is an upper member, forming a clearance between the cover and the moving contact is provided. The moving contact plate is held apart from the stationary contact and accordingly the tilting switch is held OFF during normal operation. Therefore, if the operating lever is operated slightly obliquely, the moving contact plate will not come into contact with the stationary contact because of presence of the spacer member, thereby holding the tilting switch OFF.

6 Claims, 12 Drawing Sheets

MULTI-DIRECTIONAL INPUT DEVICE

BACKGROUND OF THE INVENTION

1. Field of the Invention

This invention relates to a multi-directional input device capable of actuating a switch by pushing and tilting an operating lever.

2. Description of Related Art

By referring to FIGS. 17 to 19, a conventional multi-directional input device will be explained. On the inside bottom surface of a housing 1 there are arranged a stationary contact 2 and a common contact 3, and are formed a moving contact plate 4 and a push switch S1.

Above the moving contact plate 4, there is provided a guide portion 5 having a cantilever type pushing portion 5*a*. A rubber elastic body 6 is mounted on the pushing portion 5*a*, so that the pushing portion 5*a* may be operated by the operating lever 14 through the rubber elastic body 6.

The open end of the housing 1 is closed with a cover 7 which is provided with a plurality of stationary contacts 10 embedded in the underside thereof. On the cover 7 a connecting member 9 is fitted to thereby attach the cover 7 to the housing 1.

Inside of the housing 1, there is disposed a moving contact plate 11 made of a metal plate. Between the moving contact plate 11 and the inside bottom surface of the housing 1 a coil spring 12 is interposed to thereby elastically hold, during a normal operation, the moving contact plate 11 in contact with the stationary contact 10. Thus the coil spring 12 electrically connects the moving contact plate 11 with the common contact 3, so that the group of the stationary contacts 10 and the moving contact place 11 form eight tilting switches S2.

The moving contact plate 11 is embedded in the moving member 13, which is inclinably fitted in a through hole 7*a* of the cover 7.

The operating lever 14 which can be pushed and inclined is projecting out at the upper portion through the through hole 13*a* of the moving member 13, and is engaged at the lower portion with the moving member 13 and in contact with the rubber elastic body 6.

Next, operation of a conventional multi-directional input device will be explained. When the operating lever 14 is in neutral position shown in FIG. 17, the moving contact plate 4 in the push switch S1 is off the stationary contact 2; that is, the contact is in OFF position. In the case of the tilting switch S2, the moving contact plate 11 is in contact with all of the stationary contacts 10; that is, all of the contacts are in the ON position.

When the operating lever 14 is tilted from the neutral position in an arbitrary direction, for instance in a direction shown in FIG. 18, the moving contact plate 11 rotates on the stationary contact 10 as a support located on the opposite side in the direction of tilting, off from other stationary contacts 10; therefore, the tilting switch S2 corresponding to the stationary contact 10 as a support remains in the ON position, while the other tilting switches S2 are turned to the OFF position.

With the tilting operation of the operating lever 14, the lower end of the operating lever 14 pushes the moving contact plate 4 into contact with the stationary contact 2 via the rubber elastic body 6 and the pushing portion 5*a*, thus switching the push switch S1 from the OFF to the ON position.

When the operating lever 14 is raised from the tilted position, the moving contact plate 1 is moved back to its original position by the force of the coil spring 12. The operating lever 14, therefore, returns to its neutral position shown in FIG. 17 and all of the eight tilting switches S2 are reset to the ON position.

Also the rubber elastic body 6, the pushing portion 5*a*, and the moving contact plate 4 recover with because of their own respective elasticities; the moving contact plate 4 moves away from the stationary contact 2, thus resetting the push switch S1 to the OFF position.

The input device operates similarly when the operating lever 14 is tilted in a different direction than FIG. 18.

Next, the operating lever 14, when axially pushed from neutral position in FIG. 17, is guided by the through hole 13*a* of the moving member 13, and moves downwardly thus pushing the moving contact plate 4 through the rubber elastic body 6 and the pushing portion 5*a*.

In this case, the moving contact plate 11 and the moving member 13 do not remain in contact, and therefore the tiling type switch S2 set to the OFF position; when the moving contact plate 4 has come into contact with the stationary contact 2, the push switch S1 flips from OFF to ON.

When the operating lever 14 is released from the pushing operation, the rubber elastic body 6, the pushing portion 5*a*, and the moving contact plate 4 are reset because of their respective elasticities. Since the moving contact plate 4 no longer contacts the stationary contact 2, the push switch S1 also is set to OFF again.

In the multi-directional input device of the above-described constitution, when the stationary contact 2 and the stationary contact 10 group for example are connected to a microcomputer, the microcomputer can detect the direction in which the operating lever 14 is tilted and pushed, in accordance with ON/OFF signals between the stationary contacts 2 and 10.

The conventional multi-directional input device is of such a configuration that in normal operation the tilting switch S2 is in ON position; in this state, therefore, the operating lever 14 can not easily be pushed in the axial direction, and there are times when the operator is required to push the operating lever 14 a little obliquely, operating the tilting switch S2 by mistake, which will result in misoperation of the input device.

SUMMARY OF THE INVENTION

According to this invention, a novel multi-directional input device is provided as the first means which avoids the above-described problems. The input device is comprised of an upper member and a lower member which are formed in one body through a housing space, a push switch disposed on the lower member, a tilting switch including stationary contact groups arranged at a specific spacing in the circumferential direction of the upper member and a moving contact plate arranged oppositely to these stationary contact groups, a moving member fitted with the moving contact plate, an operating lever so held in the housing space that the operating lever can be pushed and tilted and protrude outward through the through hole of the moving member, and a spring member for pushing the moving contact plate toward the stationary contact group side. There is provided a space between the upper member and the moving contact plate, and a spacer member is installed for holding the tilting switch in an OFF position during normal operation. When the operating lever is axially pushed, the push switch is actuated to ON; and when the operating lever is tilted, both the tilting switch and the push switch are actuated to ON.

As the second means for solving the problems, the spacer member is formed integrally with the moving member.

As the third means for solving the problems, the spacer member is formed integrally with the upper member.

As the fourth means for solving the problems, the spacer member is formed of a ring-shaped insulating plate.

As the fifth means for solving the problems, the spacer member is formed on the operating lever side between the upper member and the moving contact plate which are axially disposed in opposite positions.

As the sixth means for solving the problems, the moving contact plate has projecting portions radially extending at a specific spacing, and projections provided on the spacer member are arranged on a line which connects the projecting portions with the central part of the moving contact plate.

The foregoing objects and other objects will become more apparent and understandable from the following detailed description thereof, when read in connection with the accompanying drawings.

DESCRIPTION OF THE PREFERRED EMBODIMENTS

Figure 1:
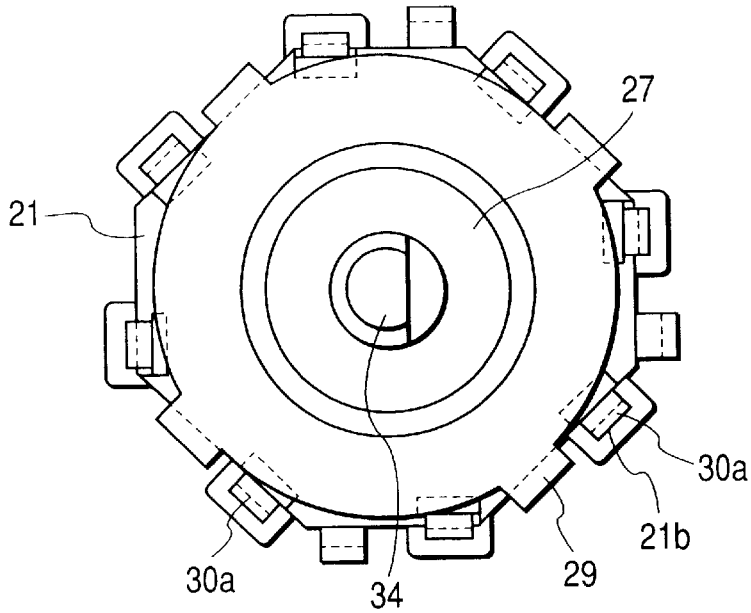
FIG. 1 is a plan view pertaining to a first embodiment of a multi-directional input device according to this invention.
Figure 2:
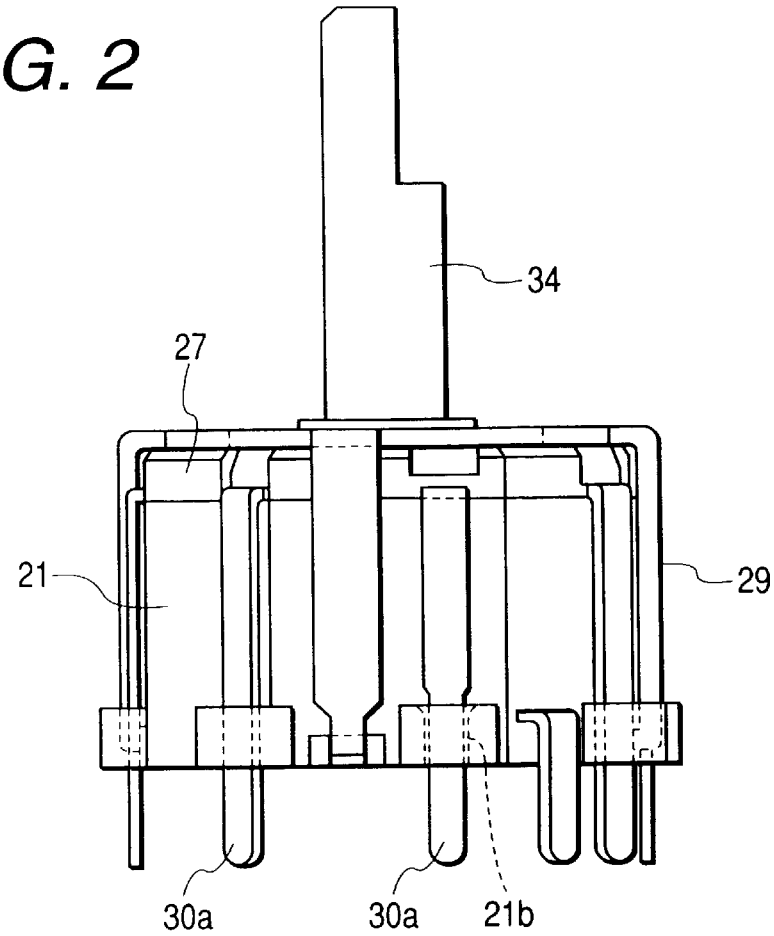
FIG. 2 is a front view pertaining to a first embodiment of the multi-directional input device according to this invention.
Figure 3:
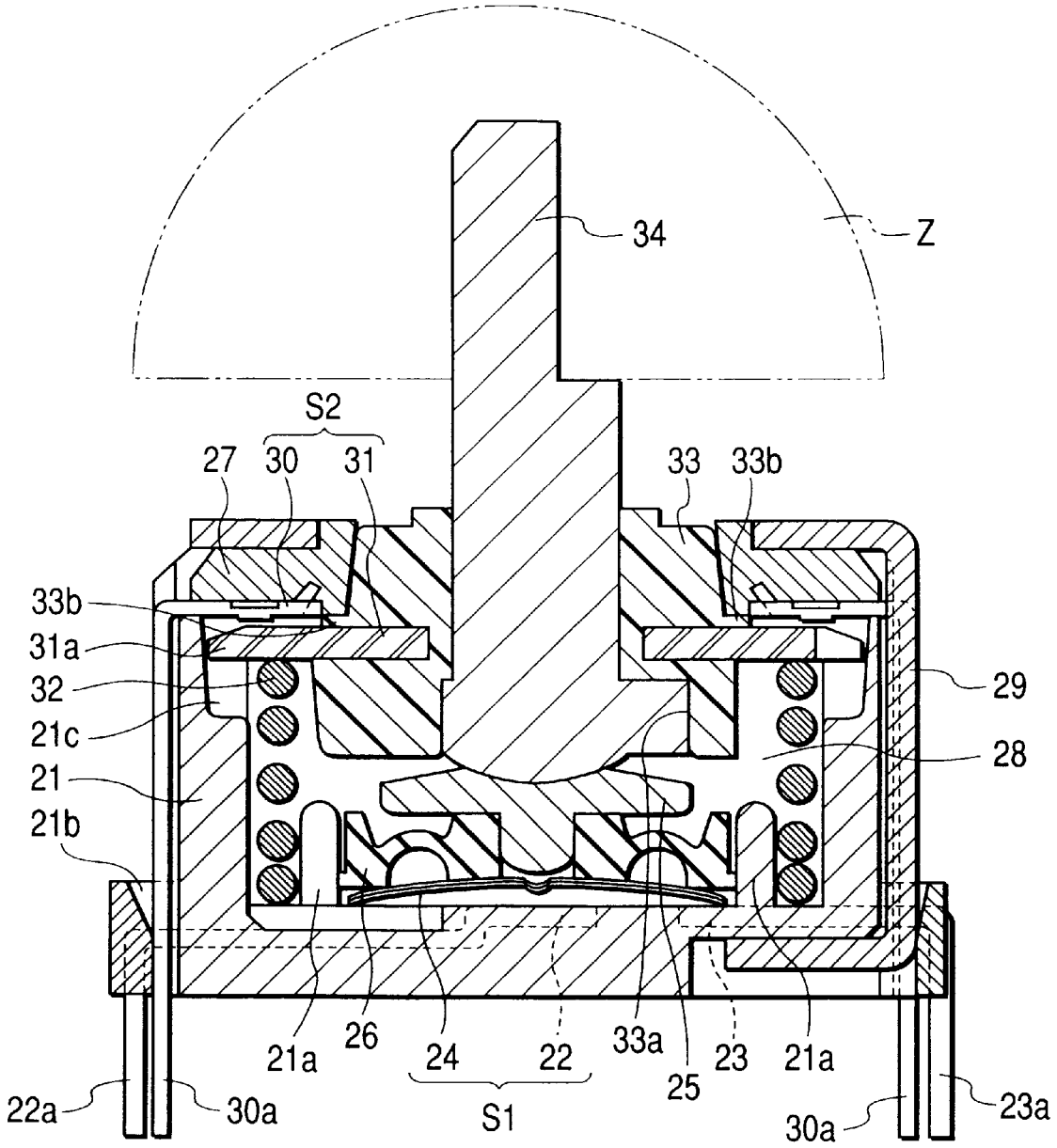
FIG. 3 is a sectional view pertaining to the first embodiment of the multi-directional input device according to this invention with the operating lever not operated.
Figure 4:
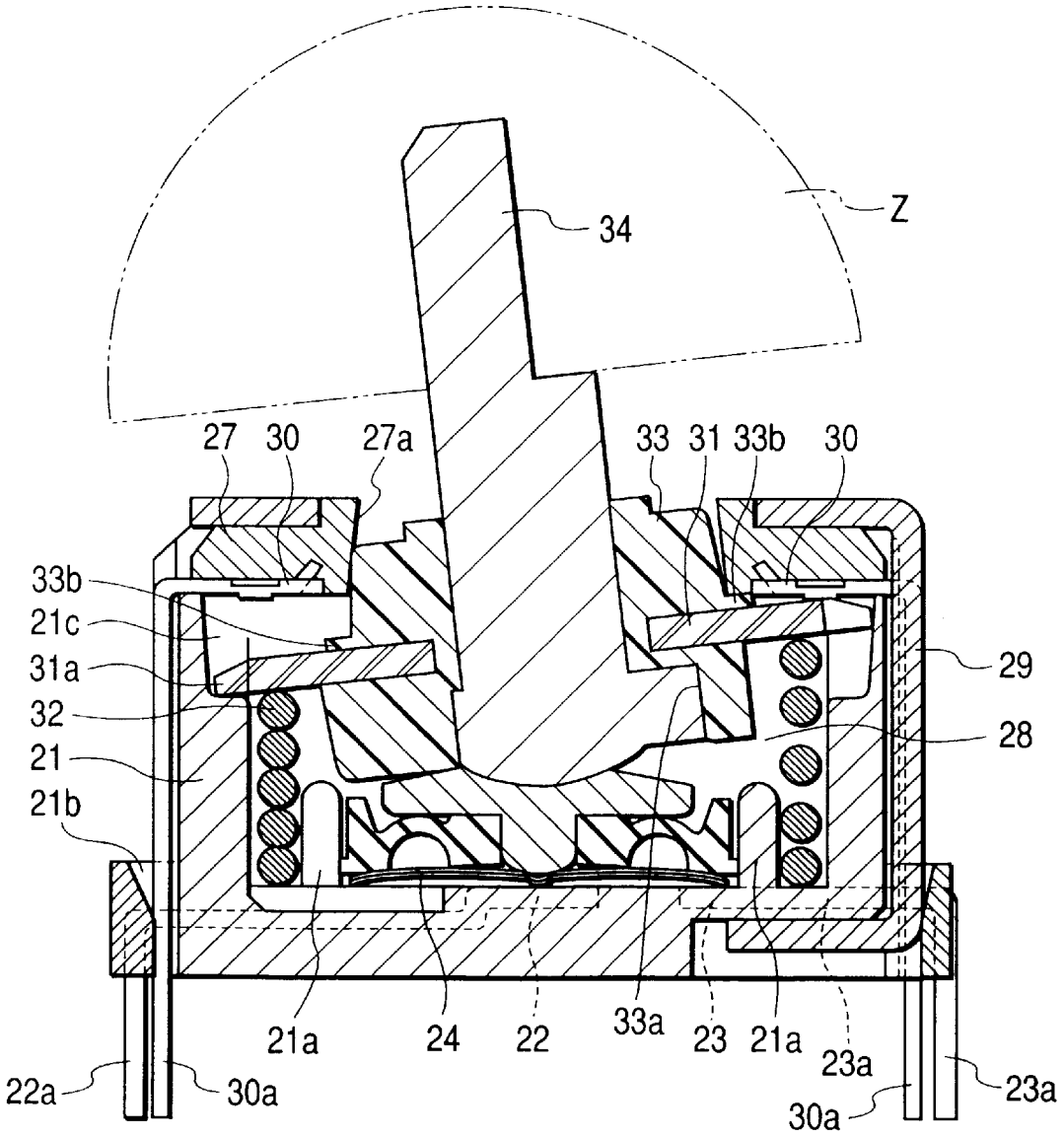
FIG. 4 is a sectional view pertaining to the first embodiment of the multi-directional input device according to this invention with the operating lever tilted.
Figure 5:
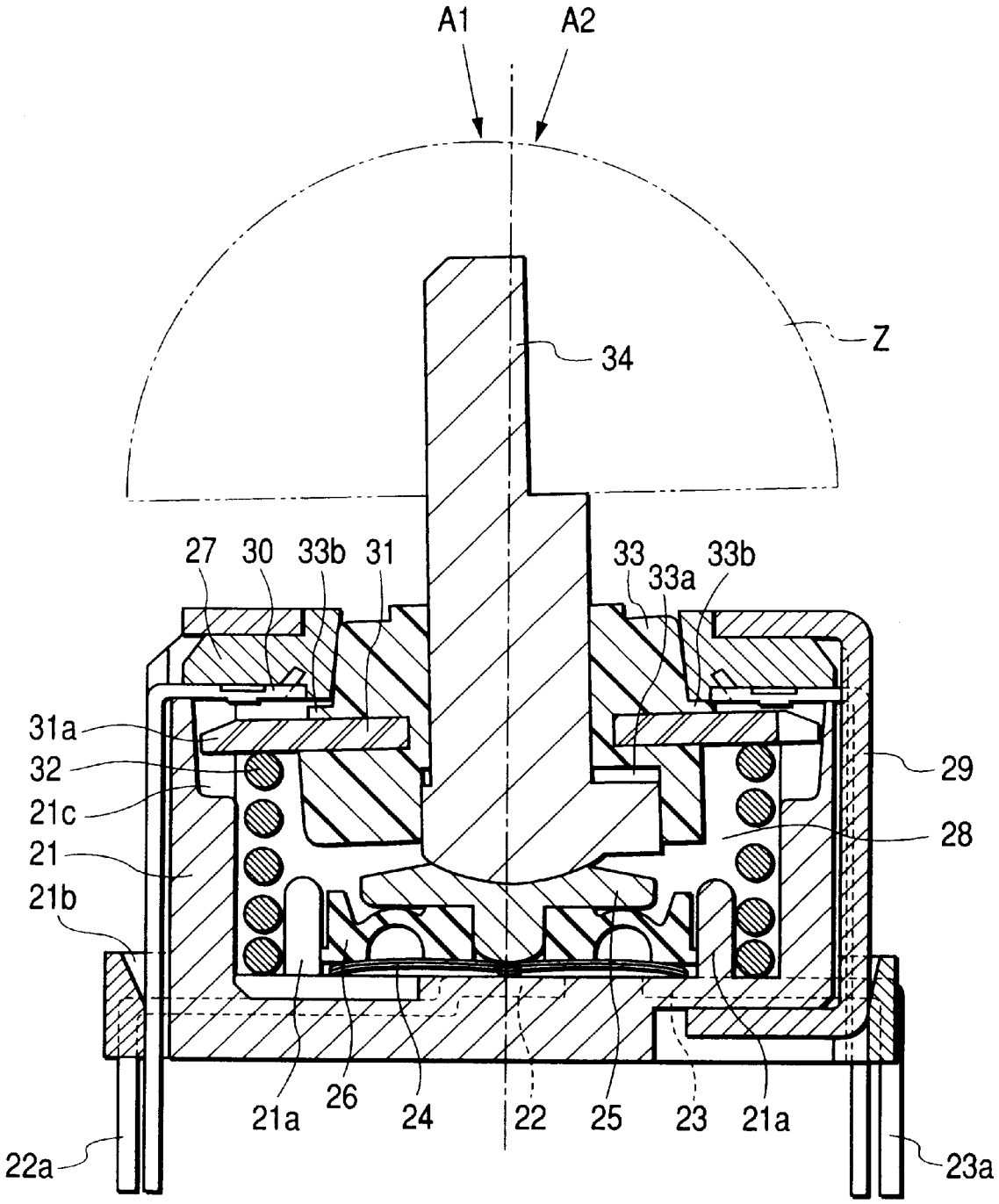
FIG. 5 is a sectional view pertaining to the first embodiment of the multi-directional input device according to this invention with the operating lever pushed.
Figure 6:
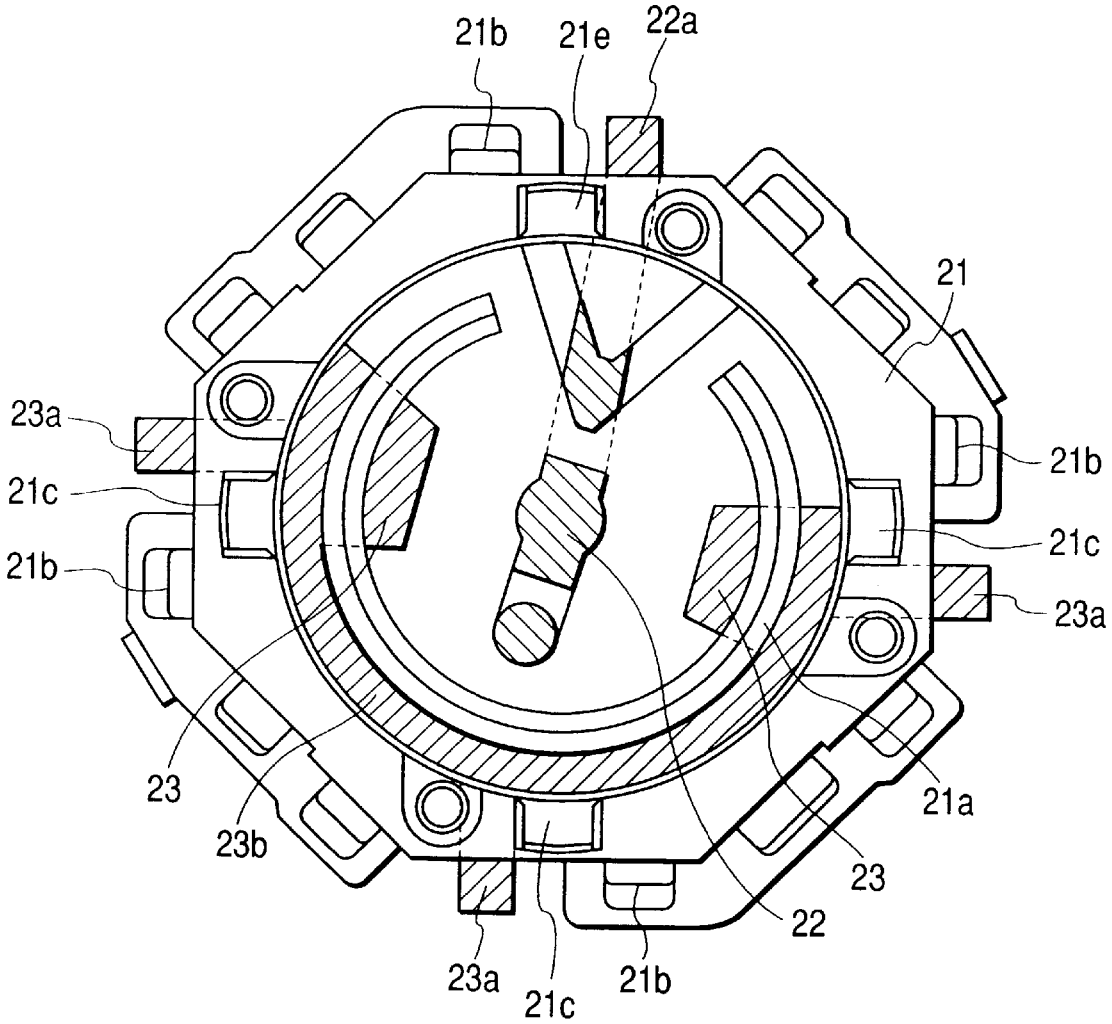
FIG. 6 is a plan view of a housing pertaining to the first embodiment of the multi-directional input device according to this invention.
Figure 7:
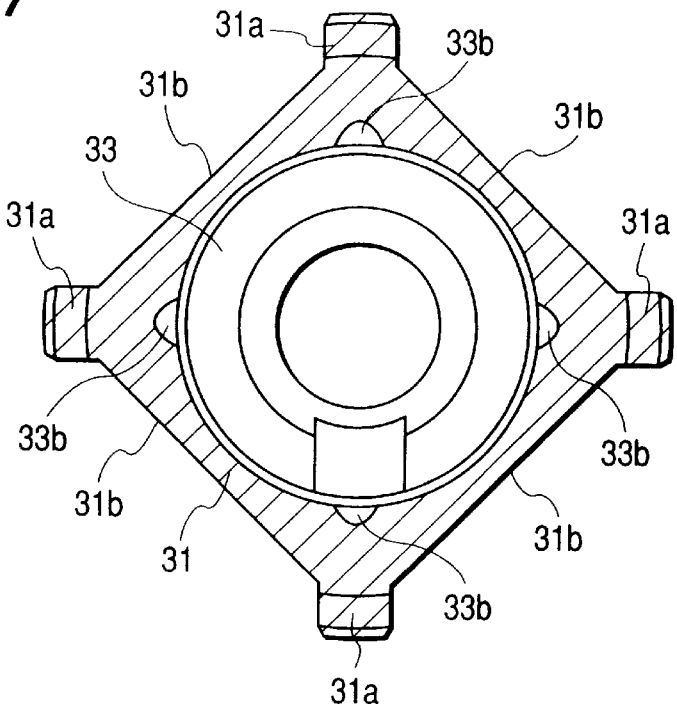
FIG. 7 is a plan view of a moving contact plate pertaining to the first embodiment of the multi-directional input device according to this invention.
Figure 8:
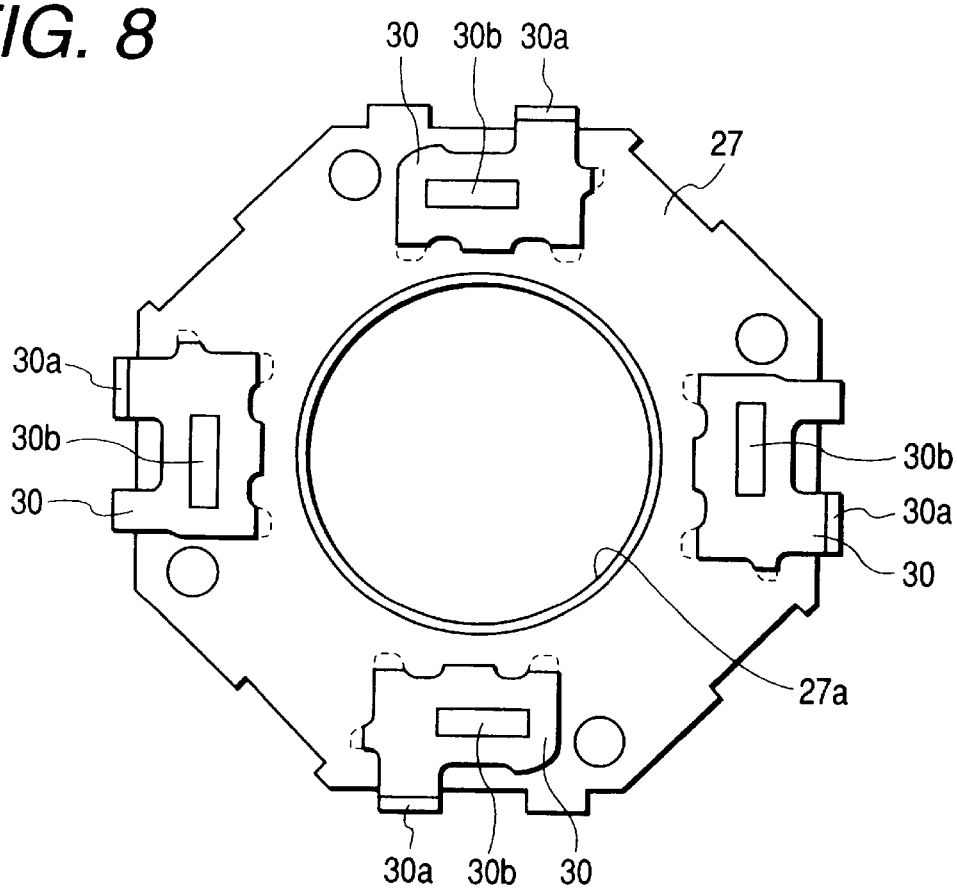
FIG. 8 is a bottom view of a cover pertaining to the first embodiment of the multi-directional input device according to this invention.
Figure 9:
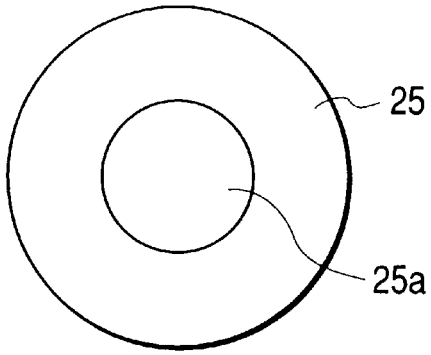
FIG. 9 is a plan view of a push member pertaining to the first embodiment of the multi-directional input device according to this invention.
Figure 10:
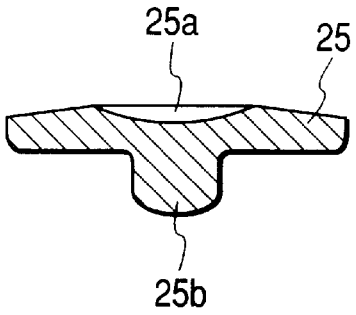
FIG. 10 is a sectional view of the push member pertaining to the first embodiment of the multi-directional input device according to this invention.
Figure 11:
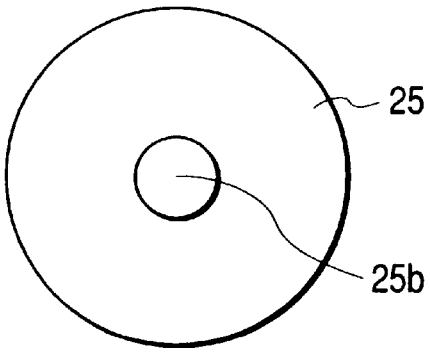
FIG. 11 is a bottom view of the push member pertaining to the first embodiment of the multi-directional input device according to this invention.
Figure 12:
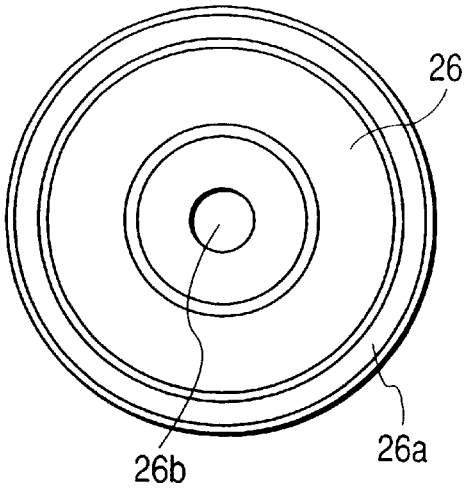
FIG. 12 is a plan view of a rubber elastic body pertaining to the first embodiment of the multi-directional input device according to this invention.
Figure 13:
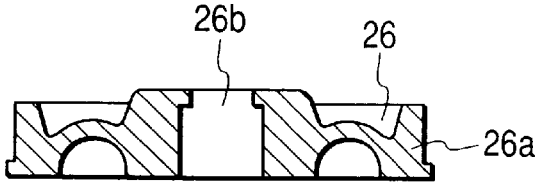
FIG. 13 is a sectional view of the rubber elastic body pertaining to the first embodiment of the multi-directional input device according to this invention.
Figure 14:
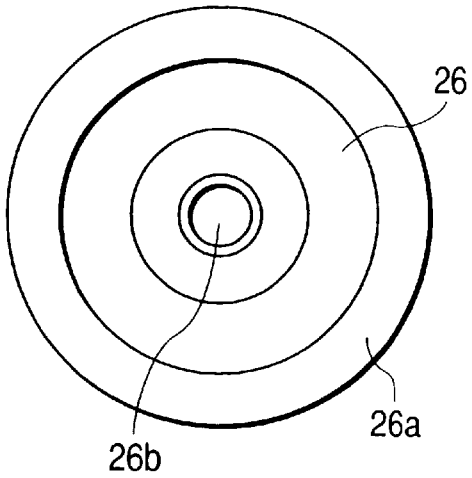
FIG. 14 is a bottom view of the rubber elastic body pertaining to the first embodiment of the multi-directional input device according to this invention.

A multi-directional input device of this invention will be explained with reference to FIGS. 1 to 14, each of which pertains to a first embodiment of the multi-directional input device according to this invention. FIG. 1 is a plan view; FIG. 2 is a front view; FIG. 3 is a sectional view showing the input device in a non-operational state; FIG. 4 is a sectional view of the input device with the operating lever tilted; FIG. 5 is a sectional view of the input device with the operating lever pushed; FIG. 6 is a plan view of a housing; FIG. 7 is a plan view of a moving contact plate; FIG. 8 is a bottom view of a cover; FIG. 9 is a plan view of a push member; FIG. 10 is a sectional view of the push member; FIG. 11 is a bottom view of the push member; FIG. 12 is a plan view of a rubber elastic body; FIG. 13 is a sectional view of the rubber elastic body; and FIG. 14 is a bottom view of the rubber elastic body.

Next, referring to FIGS. 1 to 14, the first embodiment of the multi-directional input device of this invention will be explained. A housing 21 made of a synthetic resin has at the top an opening approximately octagonal in a plan view. On the inside bottom surface of the housing which forms the lower member, a lower stationary contact 22 located at center and two common contacts 23 located in the periphery are arranged as shown in FIG. 6. The lower stationary contact 22 and each of the common contacts 23 protrude as a stationary terminal 22*a* and a common terminal 23*a* respectively out of the housing 21.

In FIG. 6, hatch lines and broken lines indicate connection between the lower stationary contact 22 and the stationary terminal 22*a*, and between a common contact 23 and a common terminal 23*a*.

On the inside bottom surface of the housing 21 there is provided a circular projection 21*a*, which is formed on the same circle at the center of the stationary contact 22.

As shown in FIG. 6, a guide hole 21*b* is formed in the outside wall on each side of the housing 21; and four cutout portions 21*c* are formed at a 90-degree spacing on the open end side of the inside wall of the housing 21.

Also on the inside bottom surface of the housing 21 a dome-shaped moving contact plate 24 is provided. The position of this moving contact plate 24 is restricted by means of the projection 21*a*.

The moving contact plate 24 is constantly in contact with the common contact 23, and is off from the stationary contact 22. The push switch S1 is comprised of this moving contact plate 24 and the stationary contact 22.

Inside of the projection 21*a* a compound body comprising a push member 25 and a rubber elastic body 26 is positioned, oppositely to the upper, central part of the moving contact plate 24.

The push member 25 has a shallow spherical receiving section 25*a* in the upper surface and a projecting portion 25*b* on the underside as shown in FIGS. 9 to 11. The rubber elastic body 26, as shown in FIGS. 12 to 14, has an outer peripheral portion 26*a* which fits for positioning on the projection 21*a*, and a through hole 26*b* in which the projecting portion 25*b* of the push member 25 is inserted. The rubber elastic body 26 is mounted on the moving contact plate 24.

The open end of the housing 21 is closed with a cover 27 made of a synthetic resin which forms an upper member of the housing 21. A housing space 28 is formed of the housing 21 and the cover 27.

In the underside of the housing 21 an upper stationary contact 30 is embedded. The upper end portion of a connecting member 29 having a plurality of mounting legs is bent to hold the cover 27; the mounting legs are extended downwardly along the outside wall of the housing 21 and the lower end portion of the mounting legs is bent inwardly, thereby connecting the housing 21 and the cover 27.

As shown in FIG. 8, a through hole 27*a* is formed in the central part of the cover 27 and four upper stationary contacts 30 are arranged at a 90-degree spacing around the through hole 27*a*. Near the central part of each stationary contact 30, there is formed a projecting portion 30*b* projecting a little downwardly.

If the exposed surface of the stationary contact 30 is partly covered with resin because of varied molding conditions when the stationary contact 30 is embedded in the cover 27, the stationary contact portion 30 projects out of the resin portion, forming a projecting portion 30*b*. Also the stationary contact 30 extends downwardly as a terminal 30*a*. Each terminal 30*a* is inserted into the guide hole 21*b* of the housing 21 as shown in FIG. 3.

In the housing space 28 is disposed the upper moving contact plate 31. Between the upper moving contact plate 31 and the inside bottom surface of the housing 21, there is interposed a spring member 32 which is a conductive coil spring; the spring member 32 being positioned between the peripheral wall of the housing 21 and the projection 21*a*.

The lower end of the spring member 32 contacts an electrically conductive portion 23*b* (the circular hatched portion in FIG. 6) which connects the common contact 23 with the common terminal 23*a*.

The moving contact plate 31 is pressed by the force of the spring member 32 toward the stationary contact 30 which is disposed on the cover 27, thereby forming four tilting switches S2 of the stationary contact 30 group and the moving contact plate 31.

The moving contact plate 31 is embedded in the moving member 33 made of a synthetic resin, upper part of which is fitted in the through hole 27*a* in the cover 27.

The moving contact plate 31 is rhombic as shown in FIG. 7, and has, on the outer periphery, projecting portions 31*a* radially extending at a spacing of 90 degrees and four straight edges 31*b* extending to connect the projecting portions 31*a*. The hatched portion in the drawing is an electrically conductive metal portion.

The upper surface of each projecting portion 31*a* is tapered, slightly decreasing in thickness as it goes toward the tip, and then is inserted as shown in FIG. 3 into the cutout portion 21*c* formed in the inside wall surface of the housing 21, to be thereby locked from turning circumferentially.

As a result of provision of each projecting portion 31*a* with the tapered upper surface, the straight extending end portion of the moving contact plate 31 makes a line contact with the underside of the cover 27 without interference of the projecting portion 31*a* when the moving contact plate 31 is tilted.

Therefore, the taper is formed to allow escape of the projecting portion 31*a* without contacting at this part; each projecting portion 31*a* has a function only to lock from turning.

The moving member 33 is provided with a through hole 33*a* having an oval lower part, in which the base end portion of a metallic operating lever 34 is inserted.

The operating lever 34 which can be pushed and tilted is axially movable in relation to the through hole 33*a*. However, the operating lever 34, splined with the oval part of the through hole 33*a*, is restricted from turning in the circumferential direction. Also, the upper portion of the operating lever 34 passes through the through hole 33*a*, protruding out of the cover 27, while the lower end thereof is in contact with the receiving portion 25*a* of the push member 25.

Formed integrally with the moving member 33, as shown in FIG. 7, is the spacer member 33*b*, which is comprised of four projections of the same shape on the operating lever 34 side. The spacer member 33*b* is formed on a line connecting the projecting portion 31*a* of the moving contact plate 31 and the central part of the moving contact plate 31. The moving member 33 is moved upwardly as the moving contact plate 31 is pushed by means of the spring member 32. Consequently, the spacer member 33*b* is interposed between the moving contact plate 31 and the cover 27 which is the upper member, to thereby provide a clearance between the cover 27 and the moving contact plate 31, thus disposing the moving contact plate 31 apart from the stationary contact 30 to hold the tilting switch S2 in the OFF position during normal vertical operation.

Next, operation of the multi-directional input device according to this invention will be explained. When the operating lever 34 is in neutral position shown in FIG. 3, the moving contact plate 24 is apart from the stationary contact 22; therefore the push switch S1 is OFF. And since the moving contact plate 31 does not contact any of the stationary contact 30 group, the four tilting switches S2 are in the OFF position.

When the operating lever 34 is tilted by the use of a knob Z from neutral position to an operational direction, for instance in a direction shown in FIG. 4, the moving contact plate 31 tilts on the center of the spacer member 33*b* located on the opposite side of the tilting direction, and the stationary contact 30 located on the opposite side of the tiling direction is switched from OFF to ON and other tilting switches S2 remain OFF.

With the tilting operation of the operating lever 34, the lower end of the operating lever 34 pushes the moving contact plate 24 via the push member 25, and the push switch S1 is switched from OFF to ON when the moving contact plate 24 comes into contact with the stationary contact 22.

Even after the push switch S1 is turned ON, the operating lever 34 can continue to tilt further until the projecting portion 31*a* of the moving contact plate 31 contacts the bottom of the cutout portion 21*c* as shown in FIG. 4; an overstroke during the tilting operation is absorbed by the compressive deformation of the rubber elastic body 26.

The spacer member 33*b* is mounted on the operating lever 34 side. The spacer member 33*b* is slightly decreased in height to a proper size as it goes toward the outer periphery, so as not to interfere with the tilting operation.

When the operating lever 34 is returns from the tilted position, to the neutral position the moving contact plate 31 is returned to its original position with the force of the spring member 32. Therefore, the operating lever 34 returns to the neutral position in FIG. 3, resetting all of the four tilting switches S2 to the OFF position.

At this time, the rubber elastic body 26 and the moving contact plate 24 also return because of their respective elasticities; the moving contact plate 24 moves away from the stationary contact 22, thereby switching the push switch S2 to OFF again.

Furthermore, when the operating lever 34 is tilted to a direction between two stationary contacts 30, the moving contact plate 31 tilts on the center of the two spacer members 33*b*, and then tilts also on the center of the two stationary contacts 30. As a result, two stationary contacts 30 adjacently located in the opposite directions of tilting are switched from OFF to ON, while detecting a tilt in an oblique direction similarly to the above-described operation.

The spacer member 33*b* provided with the projections can be tilted easily and reliably on the center of the two projections when the operating lever 34 is tilted in a direction between the projections, that is, in a direction between the two stationary contacts 30. Thereafter, a smooth tilting operation is performed in a direction between the two stationary contacts 30, allowing a forced oblique tilt even if slightly deviated from the oblique direction.

A similar effect is achieved if the operating lever 34 is tilted to directions other than that shown in FIG. 4.

When pushed from the neutral position in FIG. 3 in the direction of the arrow Al as shown in FIG. 5, the operating lever 34 is guided by the through hole 33*a* of the moving member 33, moving downward to push the moving contact plate 24 via the push member 25. Upon contact of the moving contact plate 24 with the stationary contact 22, the push switch S1 is switched from OFF to ON.

Unlike a conventional lever no problem arises when the operating lever 34 is pushed vertically. However, as shown in FIG. 5, there are times when the operating lever 34 is slightly inclined when pushed, that is, in the direction of the arrow A2.

At this time, the moving member 33 is slightly inclined with the operating lever 34, but the moving contact plate 31 will not come into contact with the stationary contact 30 because of the presence of the spacer member 33*b*. The tilting switch S2, therefore, remains in OFF position.

The tilting switch S2 will not be operated if the operating lever 34 is slightly inclined during operation, thus enabling reliable and stable operation.

When the operating lever 34 is released from a push, the operating member 34, the moving member 33, and the moving contact plate 31 are returned by the spring member 32 to the position shown in FIG. 3, and also the rubber elastic member 26 and the moving contact plate 24 return because of their respective elasticities, allowing the moving contact plate 24 to seperate from the stationary contact 22 to thereby turn the push switch S1 to OFF again.

In the multi-directional input device of the above-described constitution, for instance when the stationary terminal 22*a* of the stationary contact 22 and the terminal 30*a* of the stationary contact 30 group are connected to a microcomputer, the microcomputer can detect a tilting direction of the operating lever 34, and a push applied to the operating lever 34, according to an ON/OFF signal between the stationary terminal 22*a* and the terminal 30*a*.

Figure 15:
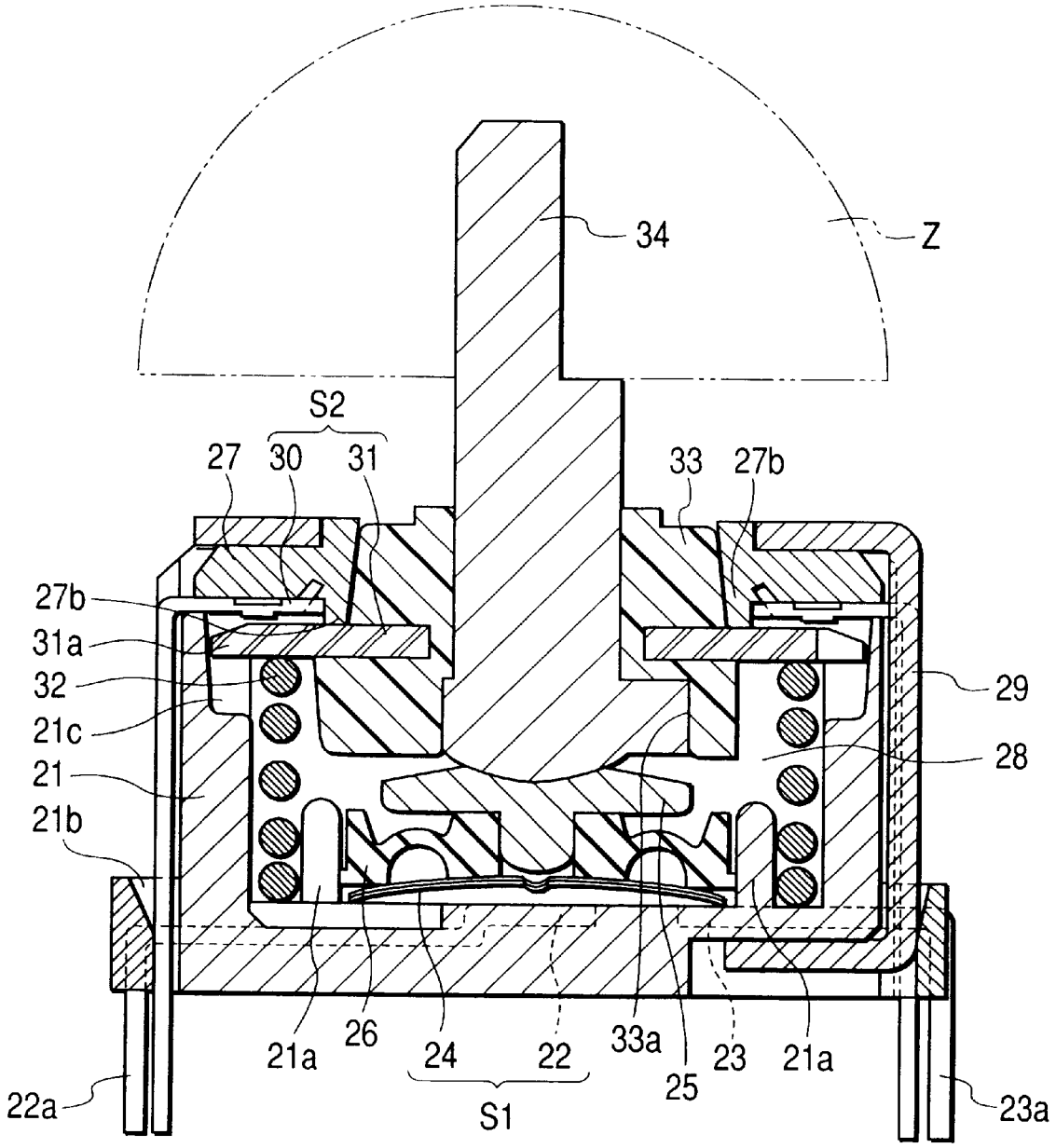
FIG. 15 is a sectional view pertaining to a second embodiment of the multi-directional input device according to this invention.

FIG. 15 shows the second embodiment of the multi-directional input device according to this invention. In the present embodiment, the spacer member 27*b* comprising a projection is integrally formed in a position on the operating lever 34 side of the cover 27. The spacer member 27*b* is formed on a line connecting the projecting portion 31*a* of the moving contact plate 31 with the central part of the moving contact plate 31, and is interposed between the moving contact plate 31 and the cover 27 which is an upper member, to provide a clearance between the cover 27 and the moving contact plate 31, thereby separating the moving contact plate 31 from the stationary contact 30. Therefore the tilting switch S2 is held in the OFF position during normal operation.

The input device is similar in other configuration to the above-described embodiment, and therefore the same components are designated by the same reference numerals and will not be explained.

Figure 16:
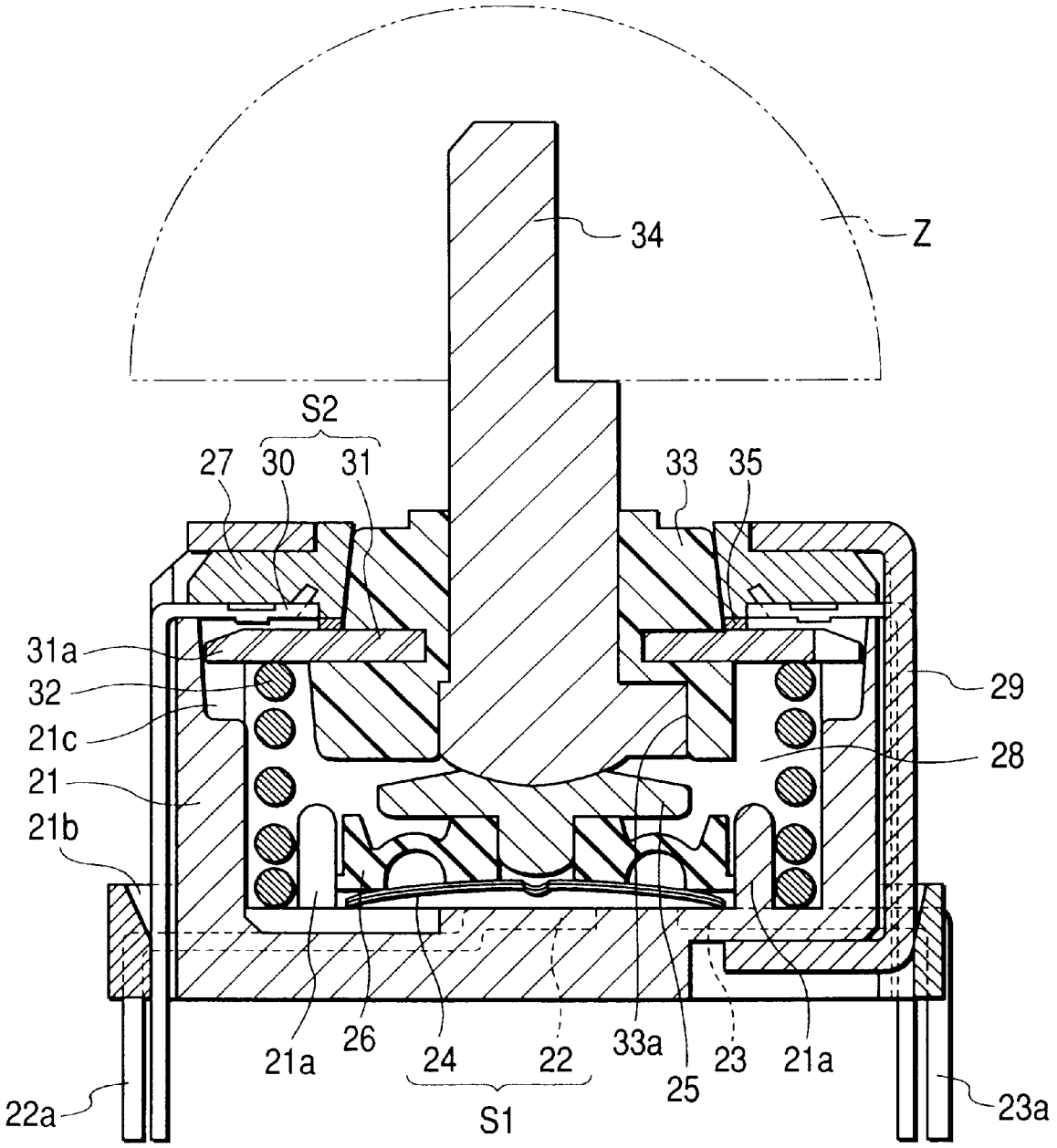
FIG. 16 is a sectional view pertaining to a third embodiment of the multi-directional input device according to this invention.
Figure 17:
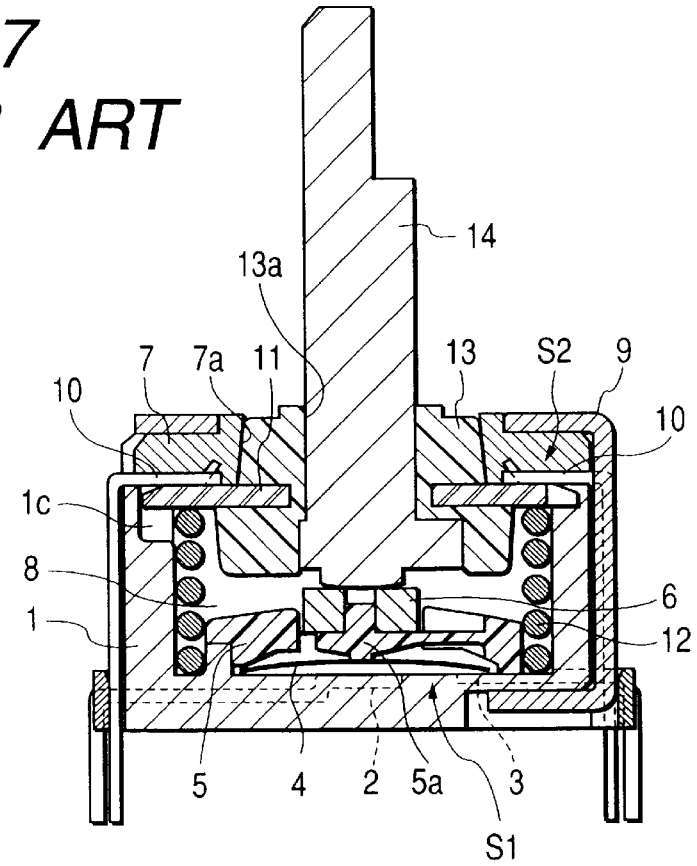
FIG. 17 PRIOR ART
FIG. 17 is a sectional view showing a conventional multi-directional input device with the operating lever not operated.
Figure 18:
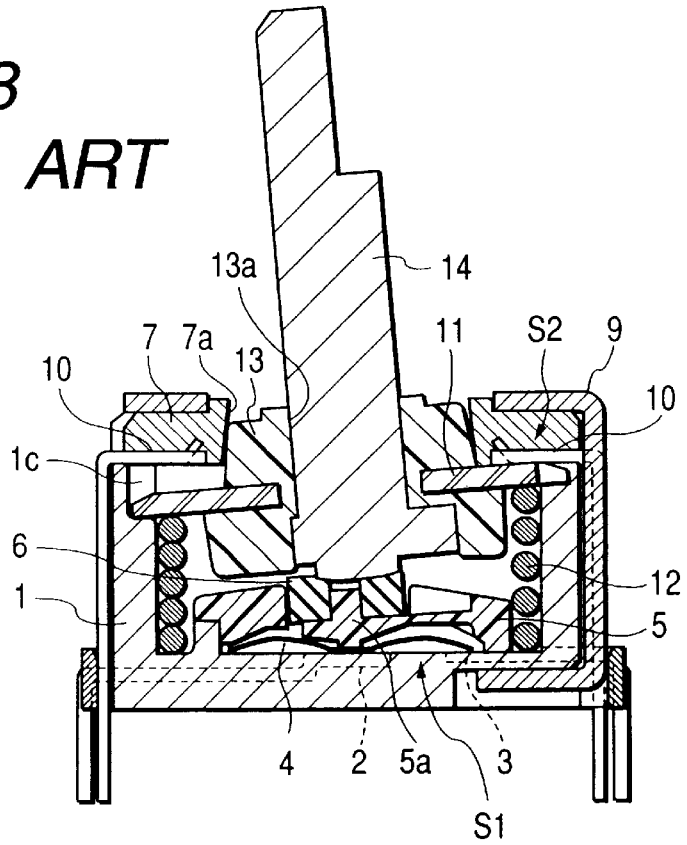
FIG. 18 PRIOR ART
FIG. 18 is a sectional view showing the conventional multi-directional input device with the operating lever tilted.
Figure 19:
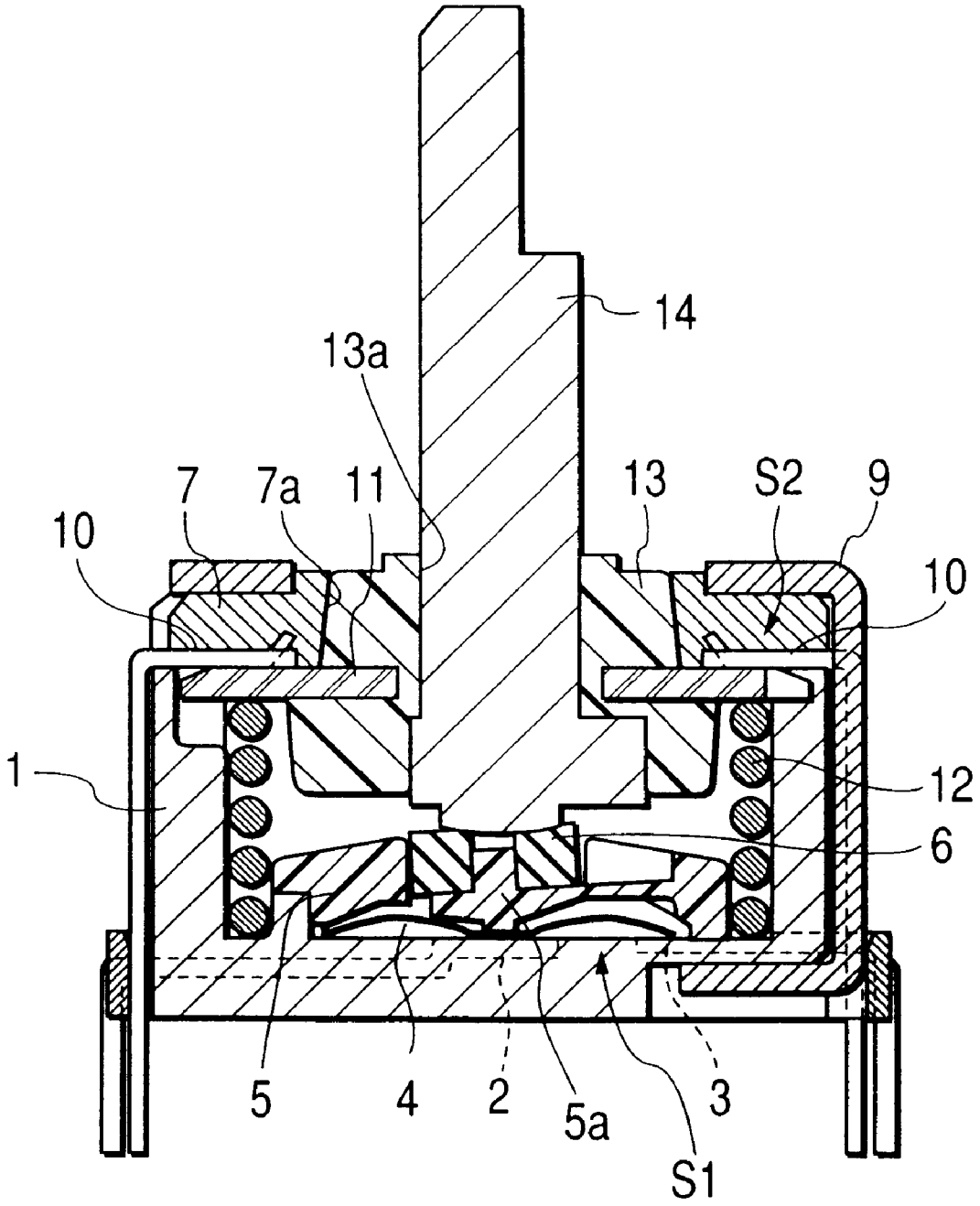
FIG. 19 PRIOR ART
FIG. 19 is a sectional view showing the conventional multi-directional input device with the operating lever pushed.

FIG. 16 shows the third embodiment of the multi-directional input device according to this invention. In the present embodiment, the spacer member 35 is made of a ring-shaped insulating plate and has projections formed on the outer periphery on a line connecting projecting portion 31*a* of the moving contact plate 31 with the center of the moving contact plate 31. The spacer member 35 is interposed between the moving contact plate 31 and the cover 27 which is an upper member, to provide a clearance between the cover 27 and the moving contact plate 31, thereby separating the moving contact plate 31 from the stationary contact 30 to hold the tilting switch S2 in the OFF position during normal operation and to insure reliable tilting operation by means of the projection when the operating lever 34 is tilted in a direction between the two stationary contacts 30.

The input device is similar in other configuration and therefore the same components are designated by the same reference numerals and will not be described.

This invention provides a multi-directional input device in which a spacer member 33*b* is interposed between a cover 27, which is an upper member, and a moving contact plate 31, to thereby provide a space between the cover 27 and the moving contact plate 31 to position the moving contact plate 31 apart from the stationary contact 30, so that the tilting switch S2 will be held OFF during normal operation. Therefore, if the operating lever 34 is operated in a slightly tilted position, the moving contact plate 31 will not be in contact with the stationary contact 30 because of the presence of the spacer member 33*b*, and the tilting switch S2 remains OFF, enabling reliable, stabilized operation.

Further, this invention provides a low-cost multi-directional input device of simple configuration and high producibility by the use of the spacer member 33*b* and the moving member 33 which are formed in one body.

Further, this invention provides a low-cost multi-directional input device of simple configuration and high producibility by the use of the spacer member 27*b* and the cover 27 which are formed in one body.

Further, this invention provides such a multi-directional input device that, because the spacer member 35 is formed of a ring-shaped insulating plate, the tilting switch S2, in which the operating lever 34 can be operated to different degrees of inclination, becomes easily operatable by replacing the plate thickness of the spacer member 35.

Further, this invention provides a multi-directional input device in which the spacer member 33*b* is formed on the operating lever 34 side between the cover 27 which is the upper member and the moving contact plate 31 which are axially disposed in opposite positions.

Further, this invention provides a multi-directional input device in which the spacer member 33*b* is provided with projections, so that the operating lever 34 can easily and reliably tilt on two projections as supporting points to a direction between the projections, that is, to a direction between two stationary contacts 30.

What is claimed is:

1. A multi-directional input device, comprising: an upper member and a lower member which are formed in one body to form a housing space; a push switch disposed on said lower member; a tilting switch including stationary contact groups arranged at a specific spacing in a circumferential direction of said upper member and a moving contact plate arranged oppositely to said stationary contact groups; a moving member fitted with said moving contact plate; an operating lever disposed in said housing space such that said operating lever can be pushed and tilted, said operating lever protruding outward through a through hole of said moving member; and a spring member for pushing said moving contact plate toward said stationary contact groups; wherein, between said upper member and said moving contact plate there is provided a clearance, a spacer member is inserted for holding said tilting switch in an OFF position during normal operation; and when said operating lever is axially pushed, said push switch is actuated and when said operating lever is tilted, both said tilting switch and said push switch are actuated.

2. A multi-directional input device according to claim 1, wherein said spacer member is formed integrally with said moving member.

3. A multi-directional input device according to claim 1, wherein said spacer member is formed integrally with said upper member.

4. A multi-directional input device according to claim 1, wherein said spacer member is formed of a ring-shaped insulating plate.

5. A multi-directional input device according to claim 1, wherein said spacer member is formed in a position on an operating lever side in which said upper member and said moving contact plate are oppositely disposed in an axial direction.

6. A multi-directional input device according to claim 5, wherein said moving contact plate has projecting portions radially extending at a specific spacing, and a projection formed on said spacer member on a line connecting said projecting portions with the center of said moving contact plate.

* * * * *